US005960597A

United States Patent [19]

Schwager

[11] Patent Number: 5,960,597

[45] Date of Patent: Oct. 5, 1999

[54] METHOD FOR POST-TENSIONING COLUMNS

[75] Inventor: Guido A. Schwager, Los Gatos, Calif.

[73] Assignee: Schwager Davis, Inc., San Jose, Calif.

[21] Appl. No.: 08/954,169

[22] Filed: Oct. 20, 1997

Related U.S. Application Data

[60] Provisional application No. 60/029,810, Oct. 24, 1996.

[51] Int. Cl.[6] ..... E04C 3/30; E04C 5/08

[52] U.S. Cl. ..... 52/223.4; 52/223.1; 52/223.14; 52/721.5; 52/723.2; 52/736.1; 52/738.1; 242/160.2

[58] Field of Search ..... 52/223.4, 223.1, 52/223.14, 721.4, 721.5, 723.1, 723.2, 738.1, 736.3; 242/160.2, 166, 170, 381.4

[56] References Cited

U.S. PATENT DOCUMENTS

| | | | |
|---|---|---|---|
| 539,485 | 5/1895 | Perret | 52/517 |
| 2,035,662 | 3/1936 | Maney | 52/223.4 |
| 2,520,402 | 8/1950 | Hirsh | 242/7 |
| 3,134,236 | 5/1964 | Baittinger | 405/250 |
| 3,145,540 | 8/1964 | Baittinger | 405/250 |
| 3,230,123 | 1/1966 | Christensen | 156/195 |
| 3,380,675 | 4/1968 | Baxter, Jr. et al. | 242/7 |
| 3,501,920 | 3/1970 | Uchiyama | 405/256 |
| 3,776,259 | 12/1973 | Kohrumel | 137/318 |
| 3,813,098 | 5/1974 | Fischer et al. | 273/72 R |
| 4,449,857 | 5/1984 | Davis | 405/286 |
| 4,725,170 | 2/1988 | Davis | 405/286 |
| 4,786,341 | 11/1988 | Kobatake et al. | 156/71 |
| 5,680,739 | 10/1997 | Cercone et al. | 52/741.3 |
| 5,799,451 | 9/1998 | Pilakoutas | 52/223.4 |
| 5,826,387 | 10/1998 | Henderson et al. | 52/295 |

FOREIGN PATENT DOCUMENTS

| | | |
|---|---|---|
| 1446425 | 8/1976 | United Kingdom . |

*Primary Examiner*—Christopher T. Kent
*Assistant Examiner*—Jennifer I. Thissell
*Attorney, Agent, or Firm*—Beyer & Weaver, LLP

[57] ABSTRACT

A method for reinforcing a structure involves winding a cable around the structure and tensioning the cable after the ends of the cable are secured. Winding the cable around the structure involves winding a portion of the cable near the top end of the structure such that at least two windings of the cable are made with a first predetermined separation between the windings, and winding another portion of the cable near the bottom end of the structure such that at least two bottom windings of the cable are made with a second predetermined separation between the bottom windings. In one embodiment, the structure is a concrete column. In another embodiment, tensioning the cable involves installing a plurality of shims between the cable and the structure at spaced locations along the cable. A structure which is reinforced using such a method is also described.

15 Claims, 6 Drawing Sheets

METHOD FOR POST-TENSIONING COLUMNS

This application claims priority under 35 U.S.C. 119(e) of Provisional U.S. patent application Ser. No. 60/029,810, filed Oct. 24, 1996, which is incorporated herein by reference in its entirety.

BACKGROUND OF THE INVENTION

1. Field of Invention

The present invention relates generally to a method and an apparatus for reinforcing columns and tanks such that the columns and tanks are better able to resist torsional forces and bending forces, and more particularly to a method and apparatus for confining columns and tanks.

2. Description of the Prior Art

Prior to the year 1971, concrete columns used to support bridges and overpasses, like those used to support overpasses over freeways, were generally not specifically built to withstand seismic events, e.g. earthquakes. A seismic event may result in the buckling of a vertical column which has not been designed to withstand the seismic event.

Concrete columns built in 1971 and before generally included vertical steel bars which were intended to reinforce the columns. However, the columns did not typically have enough hoop reinforcement to prevent buckling of the columns during earthquakes. While the concrete columns reinforced with vertical steel bars were strong enough to support superstructures like bridges, the concrete columns were often not strong enough to sustain the torsional forces and bending forces which occur during seismic events.

The San Fernando earthquake, which occurred in California in 1971, caused the failure, e.g. buckling, of a number of concrete columns due to insufficient hoop reinforcement. The columns buckled when the vertical steel bars would break loose from the concrete, especially near the base and the top of the columns, i.e. near the foundation and near the superstructure. Hence, in an effort to prevent buckling of concrete columns during earthquakes and other seismic events, since 1971, spiral reinforcement of the vertical bars in newly built concrete columns has been strongly recommended and, in some geographic areas, required. Further, a large number of concrete columns built prior to 1971 are retrofitted to provide them with sufficient hoop reinforcement, e.g., confinement of longitudinal reinforcement, to better survive seismic events.

Conventional methods used to reinforce concrete columns, particularly those built prior to 1971, include tightly, closely wrapping the column with wire to reinforce the column using transverse post tensioning, and confining the column with a steel sheet. While these methods tend to be effective in providing hoop reinforcement for concrete columns and similar structures, as for example concrete tanks, they tend to be aesthetically unpleasing and costly, as completely covering a concrete column with wire or steel can be expensive. Further, the amount of active confinement of a column in relation to the amount of wire or steel used shows that the conventional methods could be more efficient. That is, the conventional methods do not place the columns in compression, which would serve to more strongly reinforce the columns by rendering the columns to be more resistant to torsional forces and bending forces, although the columns are covered with wire or steel. As such, what is desired is a method and an apparatus for efficiently retrofitting concrete columns and similar structures which would provide an improved amount of active confinement for a given amount of steel.

SUMMARY OF THE INVENTION

To achieve the foregoing and in accordance with the purpose of the present invention, a method and an apparatus for reinforcing structures is disclosed. A method for reinforcing a structure involves winding a cable around the structure and tensioning the cable after the ends of the cable are secured. Winding the cable around the structure involves winding a portion of the cable near the top end of the structure such that at least two windings of the cable are made with a first predetermined separation between the windings, and winding another portion of the cable near the bottom end of the structure such that at least two bottom windings of the cable are made with a second predetermined separation between the bottom windings. Still another portion of the cable is wound from near the top end of the structure to near the bottom end of the structure such that windings of the portion of the cable are spaced apart as specified by a set of predetermined separations.

In one embodiment, the top windings of the cable are made with one predetermined separation between the top windings and the bottom windings of the cable are made with another predetermined separation between the bottom windings. In another embodiment, at least two of the top windings are welded together and at least two of the bottom windings are welded together to secure the cable. In still another embodiment, tensioning the cable involves installing a plurality of shims between the cable and the structure at spaced locations along the cable. In such an embodiment, the shims are installed such that the shims are separated by predetermined distances in the range of approximately 2 inches to 6 inches on concrete columns, and up to 12 inches on other structures.

A reinforced structure includes a body, a cable that is wrapped around the body to form a plurality of wraps about the body, and a multiplicity of shims positioned between the body and the cable at spaced locations along the cable for tensioning the cable. The shims and the cable cooperate to laterally confine the body. In one preferred embodiment, the body is a cylindrical body and the cable is wrapped helically around the cylindrical body. In such an embodiment, the cylindrical body may be a concrete column, a tank, a silo, a chimney, or a nuclear containment vessel.

In another embodiment, a first set of the plurality of wraps is spaced apart at a first predetermined distance in the range of approximately 1 inch to 6 inches, and a second set of the plurality of wraps is spaced apart at a second predetermined distance in the range of approximately 1 inch to 6 inches. In still another embodiment, the cable is a steel cable with a diameter in the range of approximately 0.25 to 0.8 inches.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE EMBODIMENTS

A presently preferred method and apparatus for reinforcing concrete columns and tanks in accordance with the present invention will be described below making reference to the accompanying drawings. A method for reinforcing a vertical column, as for example a concrete column, such that the column is better able to withstand seismic events involves wrapping the column with a cable, then tensioning the cable to place the column under radial compression. The cable, which is generally a post-tensioning strand, is wrapped around a column and then tensioned by adding shims between the strand and the column. As a result, the column is placed under compression, thereby reducing the possibility of the column buckling as a result of exposure to a seismic event, e.g., an earthquake. The same approach is also an effective method of reinforcing tanks, as well as prismatic structures.

Figure 1A:
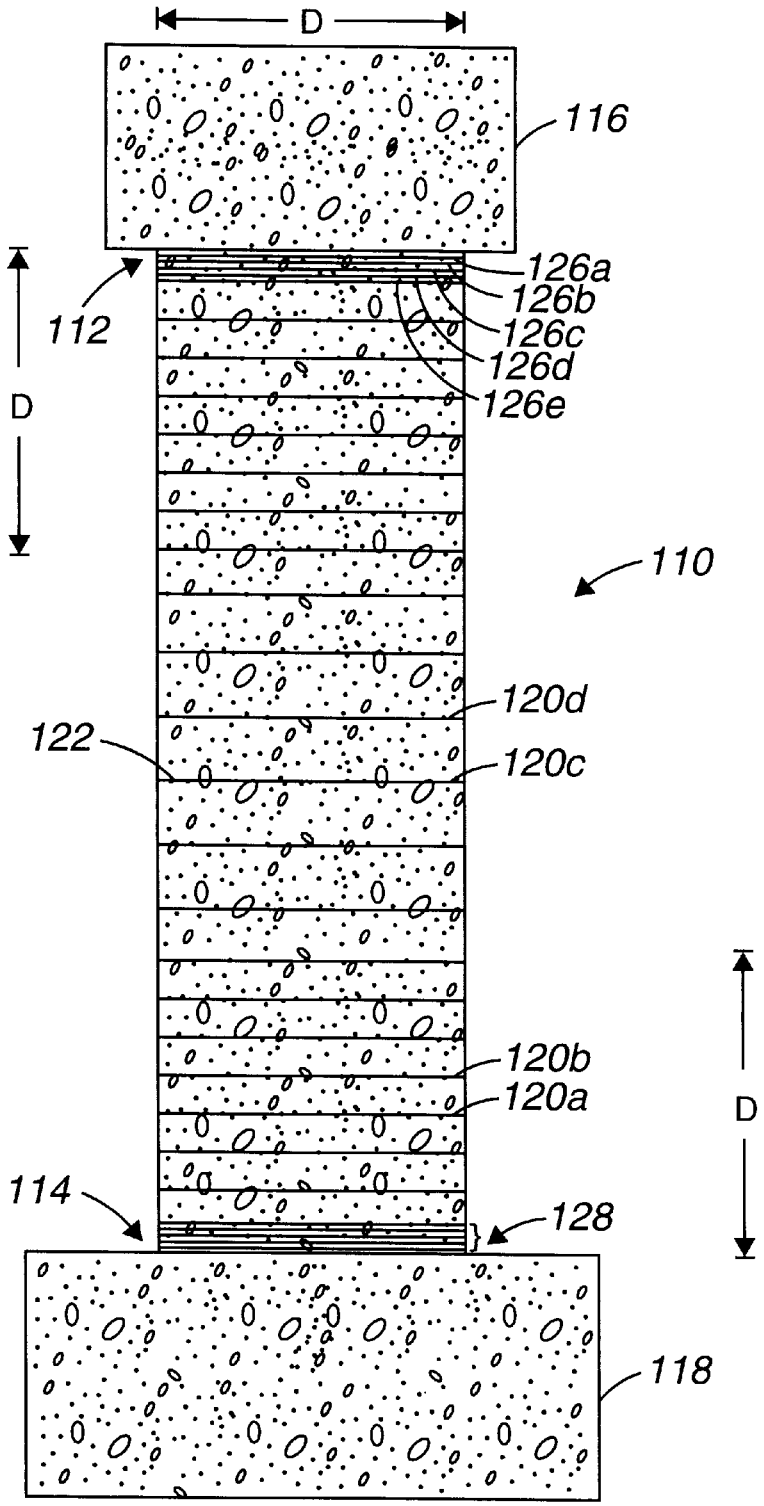
FIG. 1*a* is a diagrammatic illustration of a concrete column wrapped with post-tensioning cable in accordance with an embodiment of the present invention.

Referring initially to FIG. 1*a*, a method of wrapping post-tensioning cable around a vertical column, or a cylindrical structure, as a part of a process for reinforcing, or retrofitting, vertical columns will be described. FIG. 1*a* is a diagrammatic illustration of a concrete column wrapped with post-tensioning cable, or wire, in accordance with an embodiment of the present invention. In the described embodiment, the vertical column is a concrete column, although in other embodiments, the vertical column may be made from any material. Concrete column 110 is a cylindrical column with a round, e.g., circular, cross-section. While the diameter D of concrete column 110 is typically in the range of approximately two feet to ten feet, it should be appreciated that the actual diameter D of concrete column 110 may be widely varied depending upon the size of the load which is intended to be supported by concrete column 110.

Concrete column 110 has a top end 112 and a bottom end 114. Top end 112 carries a superstructure 116 which, in some embodiments, is a bridge or a similar structure. Superstructure 116 generally provides a load which is at least partially supported by concrete column 110. Bottom end 114 is in contact with a foundation 118, or a substructure, which supports concrete column 110. In general, foundation 118 is in contact with a ground surface. However, in some embodiments, foundation 118 may be carried by a bridge or a similar structure.

The portions of concrete column 110 near top end 112 and bottom end 114 are generally known as the "plastic hinge zones." A plastic hinge zone is the portion of concrete column 110 that typically fails, e.g., buckles, during a seismic event. In the described embodiment, the plastic hinge zone near top end 112 of concrete column 110 is the portion of concrete column 110 which extends from top end 112 to a distance of one column diameter D below top end 112. Similarly, the plastic hinge zone near bottom end 114 of concrete column 110 is the portion of concrete column 110 which extends from bottom end 114 to a distance of one diameter D above bottom end 114.

A cable, or strand, 122 is helically wrapped around concrete column 110 over the length of concrete column 110, preferably beginning at or near top end 112 and ending at or near bottom end 114. Although cable 122 may be wrapped, or wound, around concrete column 110 beginning near bottom end 114, in the described embodiment, cable 112 is wrapped beginning near top end 112 due to the fact that more tension is generally desired near foundation 118 than near superstructure 116, and as cable 122 is wrapped, tension "travels ahead," e.g., tension moves forward in cable 122. More tension is desired near foundation 118 and, hence, near bottom end 114, as it has been observed that concrete column 110 is more likely to fail near bottom end 114 than near top end 122. Cable 122 is wrapped with minimal tension, and is tensioned in subsequent processes which will be described below with respect to FIG. 1*b*. This tensioning of cable 122 provides a confining stress for concrete column 110.

Although cable 122 may be any cable suitable for post-tensioning purposes, high capacity steel cables, or wire strands, have been observed to work well. By way of example, a seven wire strand made from ASTM A416 Grade 270 steel is preferred. Further, while cable 122 may take on any suitable cross-section and size, cables with generally circular cross-sections and diameters in the range of approximately 0.25 to 0.8 inches are generally preferred. The actual preferred diameter of cable 122 is dependent upon factors such as the diameter of concrete column 110 and the final desired confining stress of concrete column 110. By way of example, for a concrete column diameter of approximately five feet and a desired confining stress in the range of approximately 200 pounds-per-square-inch (psi) away from the plastic hinge zone to 400 psi at the plastic hinge zone, a cable diameter of approximately 0.5 inches is preferred. As the diameter of concrete column 110 decreases, the preferred diameter of cable 122 also typically decreases. For example, for a concrete column diameter of approximately three feet and a desired confining stress in the range of approximately 200 psi to 400 psi, a cable diameter of approximately 0.375 inches may be preferred.

One suitable cross-section for cable 122, as described above, is a circular cross-section. A cable, as for example cable 122, with at least an approximately circular cross-section is generally easier to orient and consistently wind around concrete column 110 than a cable with an alternative cross-sectional shape, as for example a cable with a square cross-section.

As previously mentioned, cable 122 is wrapped, or wound, around concrete column 110. Any suitable method may be used to wrap cable 122 around concrete column 110 in such a way that the portions of cable 122 that are wrapped around concrete column 110 are substantially in contact with concrete column 110. By way of example, hand-wrapping methods may be used to wrap cable 122 for full contact with concrete column 110. Alternatively, machine-wrapping methods may be used instead. The wrapping is done such that there is a predetermined distance, or pitch, between "adjacent wraps," i.e., neighboring wraps or neighboring turns of cable 122. Preferred spacings between adjacent wraps are generally in the range of approximately 1 inch to 6 inches. In some embodiments, the predetermined distance may be varied. That is, the distance between two adjacent wraps, as for example wraps 120*a* and 120*b*, may vary from the distance between two other adjacent wraps, as for example wraps 120*c* and 120*d*. By way of example, wraps near a plastic hinge zone, e.g. wraps 120*a* and 120*b*, may be spaced approximately two inches apart, whereas wraps away from a plastic hinge zone, e.g., wraps 120*c* and 120*d*, may be spaced approximately four inches apart.

Varying the distance between adjacent wraps, or windings, serves the purpose of varying the amount of radial compression, or confining stress, in cable 122. It should be appreciated that the overall number of wraps of cable 122 around concrete column 110 is dependent upon many factors, as for example the desired amount of tension in cable 122 and the size, e.g., diameter, of concrete column 110. In general, more confining stress is desired at plastic hinge zones due to the fact that plastic hinge zones are the portions of concrete column 110 which are most likely to fail when subjected to the shear forces and the bending forces commonly associated with a seismic event.

The first few wraps of cable 122 near top end 112, as for example wraps 126, may be wrapped such that adjacent wraps, as for example wrap 126*a* and wrap 126*b*, are at least partially in contact with one another. Wraps 126 are intended to be used to secure, or anchor, a first end (not shown) of cable 122, and are not intended to be tensioned. To secure cable 122, at least some of wraps 126 near top end 112 are welded together, or otherwise fixed together using any suitable method. The distance, or spacing, between wraps 126 may be predetermined such that wraps 126 are easily welded, or fixed, together. Although any number of wraps 126 may be used to secure cable 122 near top end 112, a number of wraps in the range of approximately two to six wraps, as for example five wraps as shown, are preferred. The number of wraps 126 which are not intended to be tensioned, or the number of wraps 126 used to secure cable 122 near top end 112 is dependent upon factors which include, but are not limited to, the diameter of cable 122, the final amount of tension desired in cable 122, and the method used to secure, or otherwise anchor, cable 122.

It should be appreciated that in some embodiments, it may not be necessary to weld, or otherwise fix, all wraps 126 near top end 112 in order to secure cable 122. By way of example, while there may be five wraps 126*a*, 126*b*, 126*c*, 126*d*, and 126*e* which are not intended to be tensioned, strength requirements may be such that only wraps 126*a* and 126*b*, the wraps nearest to superstructure 116, need to be welded together to actually secure cable 122.

The last few wraps of cable 122 near bottom end 114, as for example wraps 128, may also be wrapped such that there is a predetermined distance between adjacent wraps. In some embodiments, adjacent wraps will be at least partially in contact. Like wraps 126 near top end 112, wraps 128 are also intended to secure, or anchor, cable 122. While any number of wraps 128 may be welded or otherwise fixed together to secure a second end (not shown) of cable 112 near bottom end 114, a number of wraps in the range of approximately two to six wraps, as for example five wraps, is preferred. As was the case for wraps 126, it should be appreciated that in some embodiments, it may not be necessary to weld, or otherwise fix, all wraps 128 near bottom end 114 in order to secure cable 122.

Securing cable 122 near top end 112 and bottom end 114 of concrete column 110 serves to enable cable 122 to remain substantially in contact with concrete column 110 after cable 122 is wrapped, or wound, around concrete column 110. With cable 122 remaining substantially in contact with concrete column 110, there will be minimal slippage of cable 122, and the predetermined distances between adjacent wraps of cable 122 may be maintained.

In general, cable 122 is wrapped around concrete column 110 with a minimal amount of tension. Although cable 122 may be wrapped around concrete column 110 such that cable 122 has the final desired amount of tension, controlling the amount of tension in cable 122 as cable 122 is wrapped is often difficult. As such, subsequent tightening processes are used to add tension to cable 122 after cable 122 is wrapped, thereby placing concrete column 110 under compression, or lateral confinement.

Figure 1B:
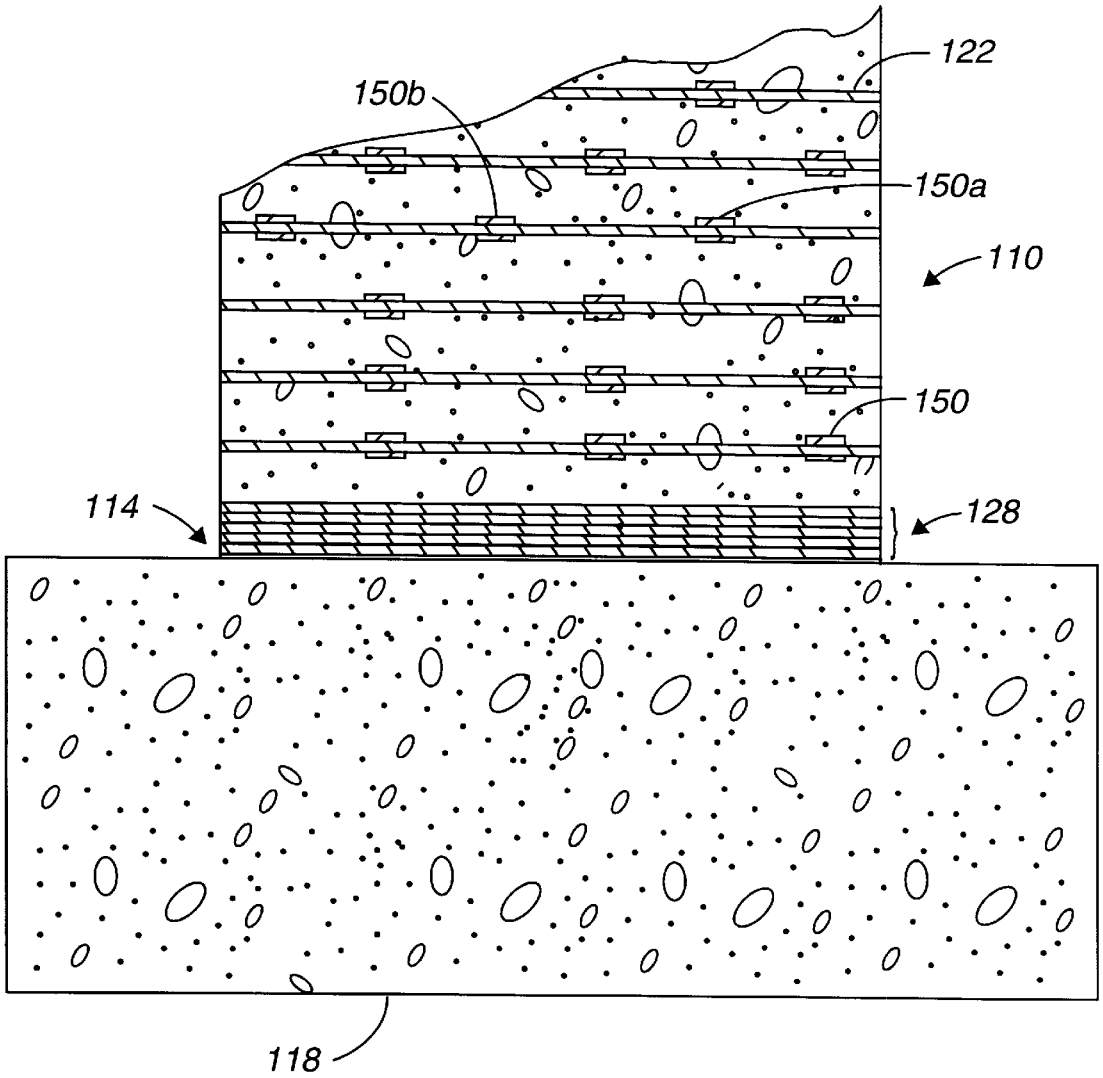
FIG. 1*b* is a diagrammatic illustration of a portion of the concrete column of FIG. 1*a*, after tensioning shims have been added in accordance with an embodiment of the present invention.

Referring next to FIG. 1*b*, a method of tensioning post-tensioning cable wrapped around a concrete column will be described. FIG. 1*b* is a diagrammatic illustration of a portion of concrete column 110 of FIG. 1*a*, after tensioning shims have been added in accordance with an embodiment of the present invention. The portion of concrete column 110 shown is near bottom end 114, or the base of concrete column 110. Shims 150, or tensioning shims, are placed between cable 122 and concrete column 110 in order to add tension to cable 122. In some embodiments, shims 150 may be secured to concrete column 110 using adhesive materials. It should be appreciated that shims 150, which may have any suitable thickness, placed between cable 122 and concrete column 110 serve to force cable 122 to "stretch" over a larger area and, therefore, increase in length. That is, the shimming process introduces tension into cable 122. As such, cable 122 is placed under tension and, thus, concrete column 110 is under compression.

While shims 150 may be made from any suitable material, in the described embodiment, shims 150 are made of steel. The size and shape of shims 150 may vary depending upon factors which include the amount of compression required for concrete column 110 In general, however, rectangular shims with a thickness in the range of approximately 0.1 inches to 1 inch are preferred, although the use of shims which conform to the shape, i.e., curvature, of concrete column 110 may also be used. In some embodiments, for structures with relatively large diameter, shims 150 may be made from concrete.

Shims 150 are placed between cable 122 and concrete column 110 using any suitable method. One suitable method requires the use of a lifting tool, which will be described below with respect to FIGS. 3*a* and 3*b*, to lift a portion of cable 122 off of concrete column 110 to enable a shim, as for example shim 150*a*, to be placed between the lifted portion of cable 122 and concrete column 110. After shim 150*a* placed between cable 122 and concrete column 110, the lifted portion of cable 122 is released such that cable 122 contacts shim 150*a*.

Shims 150 are placed such that shims 150 are spaced apart by a predetermined distance. The actual predetermined distance is dependent upon factors such as the diameter of cable 122 and the amount of tension desired in cable 122. It has been observed that for desired confining stresses in the range of approximately 200 psi to 600 psi, spacing between adjacent shims 150, as for example the spacing between shim 150*a* and shim 150*b*, in the range of approximately two to twelve inches, e.g., approximately three to ten inches, work well for concrete columns with diameters in the range of approximately two to ten feet. In particular, a spacing of approximately four inches is preferred. It should be appreciated that while any suitable spacing between adjacent shims 150 may be used, if the spacing is too large, e.g., larger than approximately ten inches, concrete column 110 may be more likely to fail during a seismic event.

In the described embodiment, the spacing between adjacent shims 150 is constant, i.e., the spacing between every two adjacent shims is the same. In order to vary tension in cable 122 when spacing between adjacent shims 150 is constant, the number of wraps of cable 122 around concrete column 110 may be adjusted. By way of example, the number of wraps of cable 122 at plastic hinge zones near bottom end 114 of concrete column 110 where a higher confining stress is desired may be higher than the number of wraps of cable 122 at other portions of concrete column 110. In other embodiments, the spacing between adjacent shims 150 may be varied to in order to vary the confining stress at different sections of cable 122.

In general, the desired tension in cable 122 varies depending upon factors such as the number of wraps of cable 122 around concrete column 110, and the size, e.g., diameter, of concrete column 110. In other words, the desired tension in cable 122 is dependent upon the lateral confinement required for a particular concrete column 110. Typically, a confining stress in the range of approximately 200 psi to 1000 psi at the plastic hinge zones as described above is desired, while a confining stress in the range of approximately 100 psi to 500 psi, as for example 200 psi, away from the plastic hinge zones is desired. Hence, stresses in cable 122 in the range of approximately 100ksi to 180 ksi, as for example approximately 130 ksi to 180 ksi, are generally desired. As a result, it is desirable for cable 122 to have the capability to easily withstand these levels of stress. One cable 122 which is capable of withstanding the desired levels of stress is the aforementioned seven wire strand made from ASTM A416 Grade 270 steel.

Figure 1C:
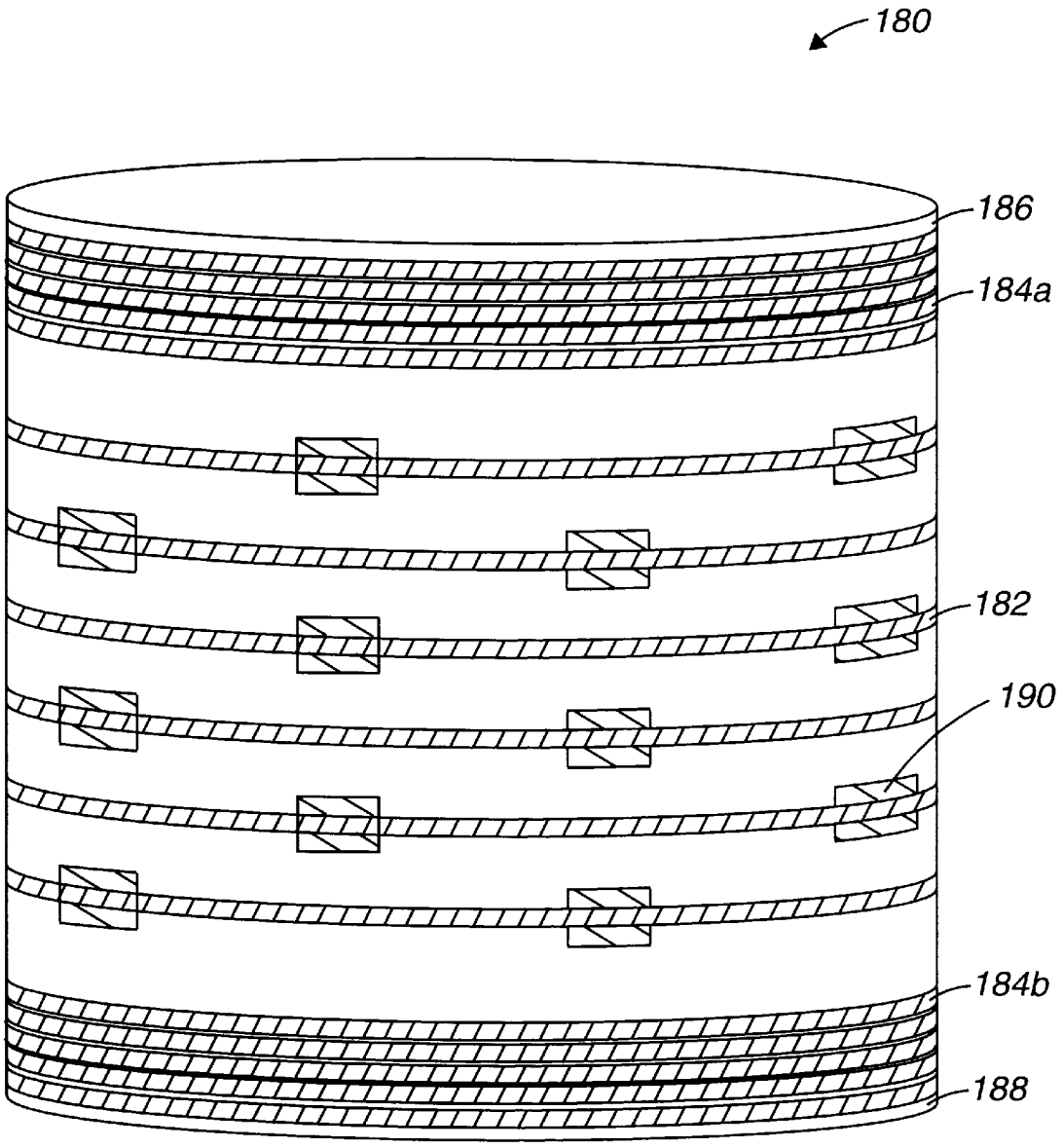
FIG. 1*c* is a diagrammatic illustration of a holding tank wrapped with post-tensioning cable in accordance with an embodiment of the present invention.

The above-described method for using shims to tension a cable in order to reinforce a concrete column may be applied to any columnar structure which may benefit from being reinforced. By way of example, the method may be applied to columnar structures which include, but are not limited to, tank-like structures such as holding tanks, silos, chimneys, and nuclear containment vessels. FIG. 1*c* is a diagrammatic illustration of a holding tank wrapped with post-tensioning cable in accordance with an embodiment of the present invention. Holding tank 180, which may be made from any suitable material, is helically wrapped with a cable 182. Wraps 184*a* of cable 182 near top end 186 of holding tank 180 are, like wraps 126 as previously described with respect to FIG. 1*a*, intended to be used to secure, or anchor, a first end (not shown) of cable 182 and are, therefore, not intended to be tensioned. Similarly, wraps 184*b* of cable 182 near bottom end 188 of holding tank 180 are also intended to secure a second end (not shown) of cable 182. Shims 190, which may be spaced apart by predetermined distances, are held between cable 182 and holding tank 180 such that the shims 190 place the cable 182 in tension. It should be appreciated that shims 190 are generally only added under portions, or wraps, of cable 182 which are to be tensioned. That is, shims 190 are not added under wraps, as for example wrap 184*a*, which are not intended to be tensioned.

The amount of tensioning required to provide an adequate amount of confining stress for tank-like structures is dependent, at least in-part, upon the pressure exerted by any fluid or material contained in the tank-like structures. That is, the inside pressure of a tank-like structure affects the amount of compression needed for the tank-like structure. In general, the amount of confining stress required for a tank-like structure may be estimated as being in the range of approximately 50 psi to 300 psi, as for example approximately 100 psi, over the confining stress required for a comparably sized concrete column.

Figure 2A:
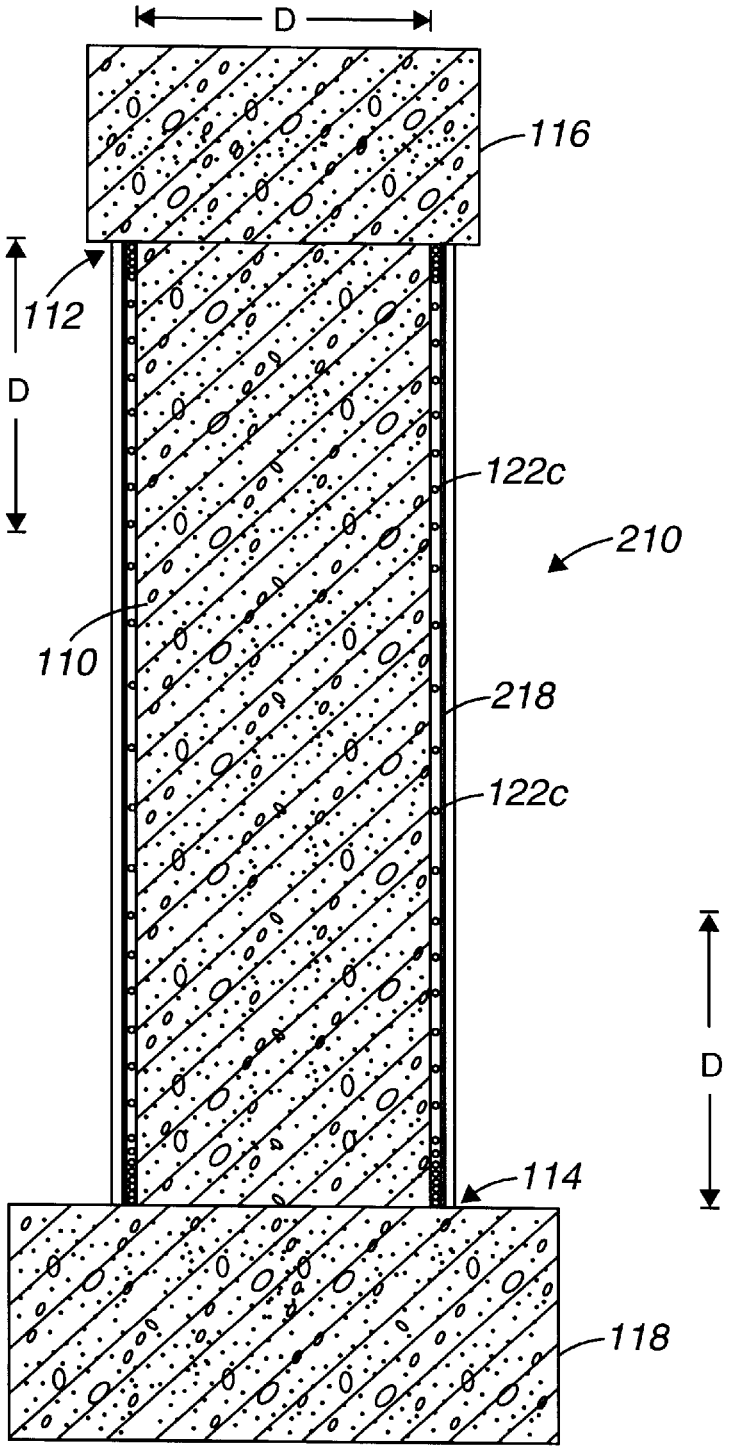
FIG. 2*a* is a diagrammatic longitudinal cross-sectional view of the concrete column of FIG. 1*b*, after a plaster layer has been added to the concrete column in accordance with an embodiment of the present invention.
Figure 2B:
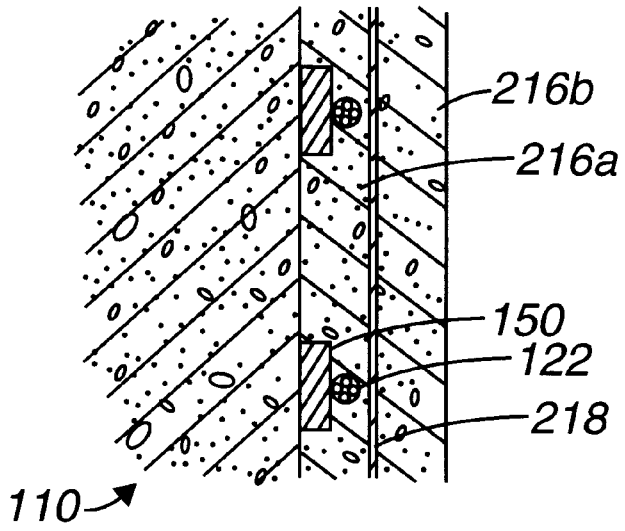
FIG. 2*b* is a diagrammatic longitudinal cross-sectional view of a portion of the concrete column of FIG. 2*a* in accordance with an embodiment of the present invention.
Figure 2C:
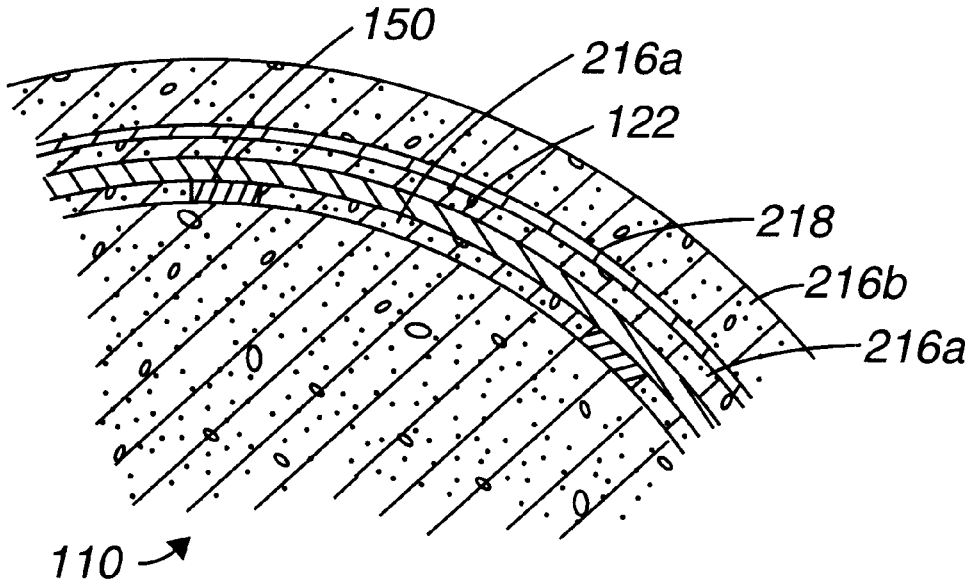
FIG. 2*c* is a diagrammatic axial cross-sectional view of the concrete column of FIG. 2*a* in accordance with an embodiment of the present invention.

With reference to FIGS. 2*a*, 2*b*, and 2*c*, the structure of a reinforced concrete column will be described. FIG. 2*a* is a diagrammatic longitudinal cross-sectional view of the concrete column of FIG. 1*b*, after a plaster layer has been added to the concrete column. FIGS. 2*b* and 2*c* are a diagrammatic longitudinal cross-sectional view of a portion of the concrete column of FIG. 2*a* and a diagrammatic axial cross-sectional view of a portion of the concrete column of FIG. 2*a*, respectively, in accordance with an embodiment of the present invention. Reinforced concrete column 210 includes a plaster layer 216 formed over cable 122 and the "original" concrete column 110, or the concrete column which was to be reinforced. In general, original concrete column 110 includes metal bars (not shown), as for example vertical steel bars, which are used to reinforce concrete column 110.

As will be appreciated by those skilled in the art, in one preferred embodiment, plaster layer 216 may be added to the exterior of a reinforced concrete column 210 as a measure of protection. That is, plaster layer 216 is added over original concrete column 110, cable 122, and shims 150 (as shown in FIGS. 2*b* and 2*c*) to protect cable 122 and shims 150 from external elements such as moisture, which may cause corrosion. Although plaster layer 216 may be made from any suitable plaster-like material, cement plaster and stucco are preferred materials.

In the embodiment as shown, wire mesh 218 is placed within plaster layer to facilitate the application of a plaster layer, as will be appreciated by those skilled in the art. When wire mesh 218 is used, a first sub-layer 216*a* of plaster layer 216 is formed over original concrete column 110, cable 122, and shims 150, and wire mesh 218 is laid over first sub-layer 216*a*. Then, a second sub-layer 216*b* of plaster layer 216 is laid over wire mesh 218. Wire mesh 218 provides a guide over which second sub-layer 216*b* may be added.

The thickness of plaster layer 216 may vary, depending upon the requirements of a particular reinforced concrete column 210. For example, a thicker cable 122 may require a thicker plaster layer 216 for coverage than a thinner cable 122 may require. In general, a plaster layer thickness in the range of approximately 0.5 inches to 2 inches is preferred. By way of example, for concrete column 110 with a diameter of approximately three feet and a cable diameter of approximately 0.375 inches, a plaster layer thickness of approximately one inch is desirable.

Figure 3A:
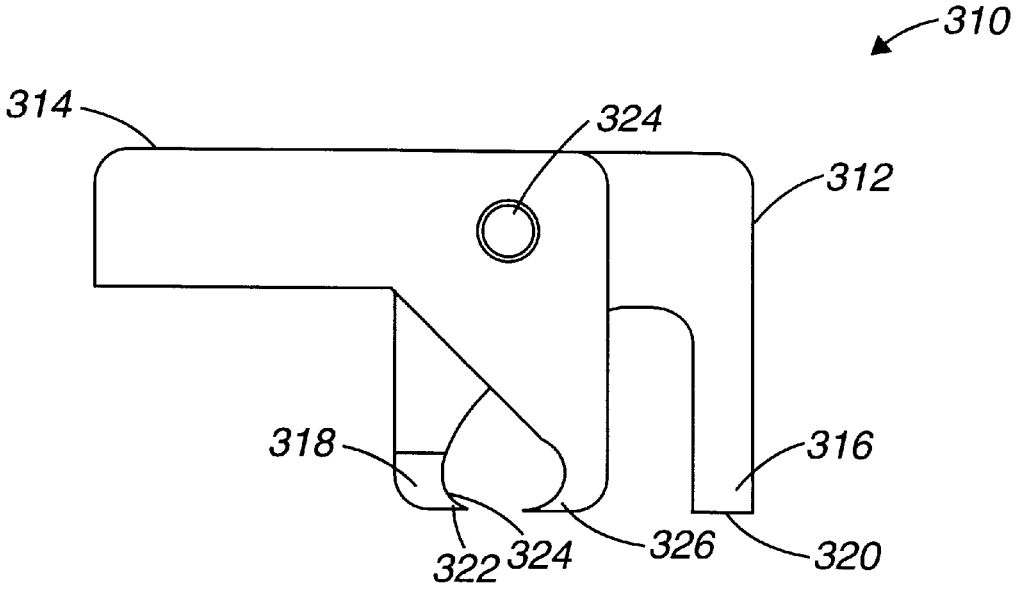
FIG. 3*a* is a diagrammatic side-view representation of a tool which is suitable for use in lifting and tensioning cables in accordance with an embodiment of the present invention.
Figure 3B:
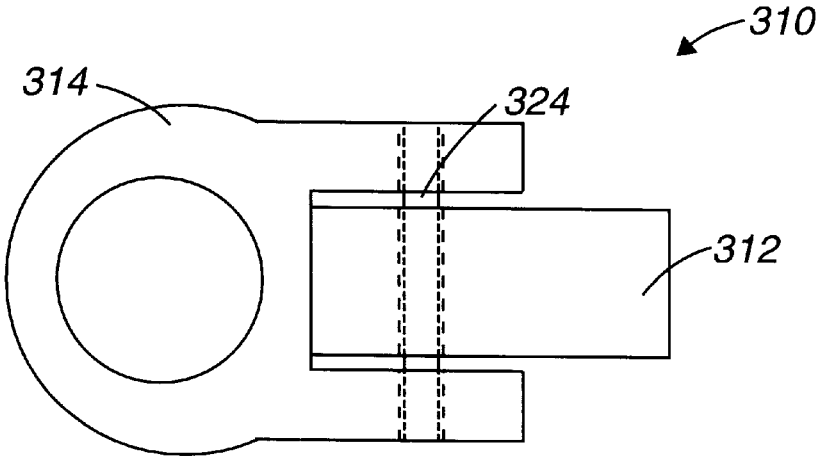
FIG. 3*b* is a diagrammatic top-view representation of the tool of FIG. 3*a* in accordance with an embodiment of the present invention.

Referring next to FIGS. 3*a* and 3*b*, one tool which is suitable for lifting a cable will be described. FIGS. 3*a* and 3*b* are diagrammatic representations of a side-view and a top-view, respectively, of a shimming tool which may be used to lift a cable wrapped around a column such that shims may be placed around the perimeter of the column in accordance with an embodiment of the present invention. Shimming tool 310 includes a brace 312 and a handle 314. Brace 312 includes an anchoring end 316 and an anchoring claw 318. Anchoring end 316, or, more specifically, anchoring edge 320 is placed such that at least part of anchoring edge 320 is flush with the surface of a column, e.g. concrete column 110, while anchoring claw 318 is hooked around a cable, e.g. cable 122, such that an anchoring tip 322 of anchoring claw 318 is at least partially between the cable and the column. In other words, brace 312 is placed such that anchoring tip 322 is hooked at least partially around cable 122 and at least part of anchoring edge 320 is in contact with concrete column 110.

In the embodiment as shown, handle 314 is rotatably coupled, through a shaft assembly 324, to brace 312. In some embodiments, bearings may be included as a part of shaft assembly 324. Handle 314 has a clamping tip 326 which may be placed such that clamping tip 326 at least partially hooks around a cable, e.g. cable 122 wrapped around concrete column 110, while anchoring edge 320 of brace 312 remains at least partially in contact with concrete column 10 and anchoring tip 322 remains hooked to cable 122. Handle 314 may be pivoted such that a portion of cable 122 is substantially captured between clamping tip 326 and anchoring tip 322, thereby enabling the portion of cable 122 to be lifted off of the surface of concrete column 110. Lifting a captured portion of cable may be accomplished in some embodiments by further pivoting handle 314. In other embodiments, the captured portion of cable 122 may be lifted by moving shimming tool 310 away from concrete column 110.

Although only a few embodiments of the present invention have been described, it should be understood that the present invention may be embodied in many other specific forms without departing from the spirit or the scope of the present invention. By way of example, although the invention has been described in terms of a concrete column, it should be appreciated that the invention may be used to reinforce a variety of different structures which include, but are not limited to, tank-like structures and columns made from other materials. Structures which have cross-sections which are not round may also be reinforced in accordance with the present invention. Such structures which have cross-sections that are not round generally include prismatic structures with any number of sides, as for example a chimney with a rectangular cross-section. It should further be understood that the ranges of cable diameters, cable tensions, and confinement stresses, in addition to materials used to form cables, may also be widely varied depending upon the size and the composition of a structure, without departing from the spirit or the scope of the present invention.

While welding some of the windings, or wraps, of a cable around a cylindrical structure has been described as one method for securing the cable, it should be appreciated that the cable may be secured using any suitable method. By way of example, in order to secure a cable to a metal containment vessel, the ends of the cable may be welded directly to the vessel.

In addition, although the use of shims to stretch and, therefore, tension a cable wrapped around a column has been described, it should be appreciated than any suitable apparatus may be used to tension the cable after the cable has been wrapped around the column. By way of example, a sheet or sheets of metal may be placed between the cable and the column to stretch the cable. Therefore, the present examples are to be considered as illustrative and not restrictive, and the invention is not to be limited to the details given herein, but may be modified within the scope of the appended claims.

I claim:

1. A method for reinforcing a structure, the structure having a top end and a bottom end, the method comprising the steps of:

winding a cable having a first end and a second end around the structure;

securing the first end and the second end of the cable such that the cable remains substantially in contact with the structure; and tensioning the cable after the first and second ends of the cable have been secured.

2. A method as recited in claim 1 wherein the structure is a cylindrical structure.

3. A method as recited in claim 2 wherein the step of winding a cable includes the sub-steps of:

winding a first portion of the cable adjacent to the first end of the cable near the top end of the cylindrical structure such that at least two top windings of the cable are made with a first predetermined separation between the top windings;

winding an intermediate portion of the cable from near the top end of the cylindrical structure to near the bottom end of the cylindrical structure such that windings of the intermediate portion of the cable are spaced apart as specified by a set of predetermined separations; and winding a final portion of the cable adjacent to the second end of the cable near the bottom end of the cylindrical structure such that at least two bottom windings of the cable are made with a second predetermined separation between the bottom windings.

4. A method as recited in claim 3 wherein five top windings of the cable are made with the first predetermined separation between the top windings and wherein five bottom windings of the cable are made with the second predetermined separation between the bottom windings.

5. A method as recited in claim 3 further comprising the steps of:

welding at least two of the windings in the first portion of the cable together; and welding at least two of the windings in the final portion of the cable together.

6. A method as recited in claim 2 wherein:

the step of securing the first end of the cable comprises welding the first end of the cable; and the step of securing the second end of the cable comprises welding the second end of the cable.

7. A method as recited in claim 2 wherein the step of tensioning the cable comprises installing a plurality of shims between the cable and the cylindrical structure at spaced locations along the cable.

8. A method as recited in claim 7 wherein the step of installing the plurality of shims comprises the sub-steps of:

(a) lifting a first section of the cable such that the first section of the cable is not in contact with the cylindrical structure;

(b) placing a first shim between the lifted first section of the cable and the cylindrical structure;

(c) releasing the lifted first section of cable such that at least a portion of the first section of cable comes into contact with the first shim; and (d) repeating sub-steps (a)–(c) for additional sections of the cable using additional shims.

9. A method as recited in claim 8 wherein the shims are installed such that the shims are separated by predetermined distances in the range of approximately 2 inches to 12 inches.

10. A method as recited in claim 9 wherein the predetermined distances are approximately 4 inches.

11. A method as recited in claim 2 wherein the cylindrical structure is a concrete column.

12. A method as recited in claim 2 wherein the cylindrical structure is one selected from the group consisting of: a tank, a silo, a chimney, and a nuclear containment vessel.

13. A method as recited in claim 2 wherein the structure is a prismatic structure.

14. A method as recited in claim 13 wherein the step of tensioning the cable comprises installing a plurality of shims between the cable and the prismatic structure at spaced locations along the cable.

15. A method for reinforcing a cylindrical structure, the cylindrical structure having a top end and a bottom end, the method comprising the steps of:

winding a first portion of a cable adjacent to a first end of the cable near the top end of the cylindrical structure such that at least two top windings of the cable are made with a first predetermined separation between the top windings;

winding an intermediate portion of the cable from near the top end of the cylindrical structure to near the bottom end of the cylindrical structure such that windings of the intermediate portion of the cable are spaced apart as specified by a set of predetermined separations;

winding a final portion of the cable adjacent to a second end of the cable near the bottom end of the cylindrical structure such that at least two bottom windings of the cable are made with a second predetermined separation between the bottom windings welding at least two of the windings in the first portion of the cable together;

welding at least two of the windings in the final portion of the cable together; and installing a plurality of shims between the cable and the cylindrical structure at spaced locations along the cable such that the shims are separated by predetermined distances in the range of approximately 2 inches to 12 inches.

* * * * *

UNITED STATES PATENT AND TRADEMARK OFFICE

CERTIFICATE OF CORRECTION

PATENT NO. : 5,960,597
DATED : October 5, 1999
INVENTOR(S) : Schwager

It is certified that error appears in the above-identified patent and that said Letters Patent is hereby corrected as shown below:

Column 6,
Line 53, change "150a placed" to -- 150a is placed --.

Column 7,
Line 29, change "100ksi" to -- 100 ksi --.

Column 9,
Line 9, change "10" to -- 110 --.

Signed and Sealed this

Second Day of April, 2002

*Attest:*

*Attesting Officer*

JAMES E. ROGAN
*Director of the United States Patent and Trademark Office*